9/8/87 XR 4,691,772

United States Patent [19]

Ebenhack et al.

[11] Patent Number: 4,691,772

[45] Date of Patent: Sep. 8, 1987

[54] PROCESS FOR OBTAINING PERMEABILITY LOGS USING RADIOACTIVE DRILLING MUD ADDITIVES

[75] Inventors: Ben W. Ebenhack, Fullerton; Robert J. Floran, Placentia, both of Calif.

[73] Assignee: Union Oil Company of California, Los Angeles, Calif.

[21] Appl. No.: 725,398

[22] Filed: Apr. 22, 1985

[51] Int. Cl.[4] ..... E21B 47/04; E21B 49/00; G01V 5/00

[52] U.S. Cl. ..... 166/254; 73/152; 166/250; 175/41; 175/50; 250/254

[58] Field of Search ..... 166/250, 254, 66; 175/41, 42, 50; 73/152; 250/254; 252/8.5 A, 8.5 B, 8.511, 8.512

[56] References Cited

U.S. PATENT DOCUMENTS

| | | | |
|---|---|---|---|
| Re. 31,122 | 1/1983 | Fertl et al. | 166/254 |
| 2,339,129 | 1/1944 | Albertson | 166/254 X |
| 2,358,945 | 9/1944 | Teichmann | 166/254 X |
| 2,364,975 | 12/1944 | Heigl et al. | 250/254 |
| 2,390,931 | 12/1945 | Fearon | 166/254 X |
| 2,429,577 | 10/1947 | French, Jr. | 166/250 X |
| 2,810,076 | 10/1957 | Mardock . | |
| 3,402,769 | 9/1968 | Doggett et al. | 166/254 |
| 3,424,903 | 1/1969 | Lawson . | |
| 3,503,447 | 3/1970 | Hamby | 166/254 |
| 3,789,219 | 1/1974 | Wilson | 250/264 |
| 3,894,584 | 7/1975 | Fertl | 166/250 |

FOREIGN PATENT DOCUMENTS 091294 12/1983 European Pat. Off. .

*Primary Examiner*—George A. Suchfield
*Attorney, Agent, or Firm*—Dean Sandford; Gregory F. Wirzbicki; June M. Bostich

[57] ABSTRACT

A method for determining the permeability profile of an uncased borehole penetrating a subterranean formation by a natural gamma ray well logging technique in which particles containing gamma ray emitting nuclides are added to a thixotropic drilling mud used to drill the wellbore such that a radioactive filter cake of the particles forms along the face of the wellbore having substantially increased thickness and intensity of radiation emissions at depths corresponding to zones of high permeability in the subterranean formation. Preferably the additive is a mud weighting particle, such as barite, bearing adsorbed or mechanically mixed, naturally-occurring radioactive material, such as thorium-bearing bastnasite or thorium-bearing cerium oxide.

21 Claims, No Drawings

PROCESS FOR OBTAINING PERMEABILITY LOGS USING RADIOACTIVE DRILLING MUD ADDITIVES

BACKGROUND OF THE INVENTION

This invention relates to procedures for generating lithologic logs of subterranean rock formations penetrated by a borehole from in situ measurement. More particularly, this invention relates to natural gamma ray well logging techniques.

Various methods have been used in the well-logging art to study the characteristics of subsurface formations by measuring the radioactivity of formations, both where the radioactivity is natural and where it is artificially induced. Generally, such methods applied to natural gamma ray well logging utilize three channels of spectra centered on the 1.46 MeV potassium-40, the 1.76 MeV uranium, and the 2.62 MeV thorium energies. Potassium, uranium and thorium are found in subsurface formations and potential reservoir rocks. In particular, potassium occurs in certain clay minerals and evaporites, while uranium is associated with depositional environments under reducing conditions or with movement of subsurface fluids over geologic time. Thorium, on the other hand, often occurs in certain formations containing detrital deposits. However, certain formations are notably thorium poor, such as the well-known Monterey formation of California. When present in sufficient quantities, potassium-40, uranium and thorium, or their daughter products, can be detected by gamma ray spectroscopic methods which pick up these characteristic channels of spectra and display the information in conventional logs.

Various techniques have been developed for utilizing the logs to locate source rocks for oil production. One such technique described in U.S. Pat. No. 4,017,755 to Supernaw et al. utilizes natural gamma ray logs to determine the organic carbon contained within a shale deposit. The gamma ray logs are used to derive potassium-/uranium or thorium/uranium ratios which, when compared with the organic carbon values at selected depths within the borehole, are used to derive curves indicating organic carbon contained at depth within the shale deposit. In thorium-poor formations, however, this well logging technique is unsatisfactory since it depends upon ratios of all three commonly occurring radioactive nuclides.

Logging techniques may also be used to determine the amount of residual oil in an oil-bearing formation after completion of primary production. In U.S. Pat. No. 3,894,584 to Fertl a method is disclosed whereby the amount of residual oil in a formation is determined by conducting a series of three loggings. First, the formation is logged to determine its natural radioactivity. This log serves as a base or reference log. Then an aqueous solution containing water-soluble radioactive contaminants is injected into the formation through the wellbore. The formation is logged a second time with the radioactive fluids in place and a third time after the radioactive fluids have been completely displaced by water from the area surrounding the wellbore. By comparing measurements of the logs with data concerning formation porosity and radioactive concentrations employed, the amount of residual oil in the formation can be determined.

Natural gamma ray logging can also be used to examine in situ formations penetrated by a borehole to determine the optimum location for performing stimulation procedures in an uncased wellbore or for perforating a casing. Such techniques are disclosed in U.S. Pat. No. Re. 31,122 to Fertl. A natural gamma ray log of the formation surrounding the borehole is made and separated into potassium-40, uranium, and thorium energy-band signals. A differential value is derived by subtracting the signal for either potassium or thorium from the signal for urnanium at depth points along the borehole. The differential is then compared to an energy level standard to constant magnitude predetermined by the lithology of the formation. Those areas having a differential value greater than the magnitude of the standard are selected for well stimulation procedures.

One particular well-logging application, and the one to which the present invention is most directly relevant, utilizes gamma ray logging of subterranean formations to locate zones of high permeability. For formations penetrated by a cased borehole, U.S. Pat. No. 3,503,447 to Hamby discloses a process for detecting and plugging zones of high permeability, such as thief zones, to normalize injectivity along an interval into which a well is completed. Radioactive particles, such as particles of anion exchange resin carrying one-half millicurie of iodine 131 per barrel of solution, are suspended in an aqueous solution to be injected into a freshly drilled wellbore. Sugar is added to equalize the specific gravity of the resin particles and the solution so that the particles remain suspended with even distribution. The radioactive particles are large enough to plate out along the face of the wellbore as the liquid filtrate from the injected solution penetrates the formation at points of high permeabililty.

Before injection of the fluid containing radioactive particles, a log is made of background radiation occurring naturally along the borehole. Then the solution bearing radioactive particles is injected and the cake of radioactive particles plated out along the wellbore is logged. Comparison of the logs determines the location of high permeability zones, which can be plugged to prevent loss of circulation fluids during drilling or other reservoir operations. This method provides the advantage of requiring little information about the subterranean formation, such as the lateral penetration and geological composition. However, its usefulness is limited to wells already encased, perforated, and undergoing production.

The disadvantage of this method is that logging takes place after two different fluids have contacted the formation and damaged the permeability of the area surrounding the wellbore. Generally, permeability of the formation surrounding the wellbore contacted by drilling fluid is altered to some degree. When a subsequent fluid is injected to log the formation, further alteration of the reservoir permeability occurs. In addition the mechanical operations involved in installing the casing can result in damage to the permeability of the area surrounding the borehole. As a result the log made after the formation has been contacted by two fluids reflects the altered permeability surrounding the wellbore rather than the true permeability of the formation as a whole.

As illustrated by Hamby, when well logging is used to determine zones of high permeability in a formation, the log can be made inaccurate if the formation has been contacted by fluids administered before the logging operations. Inaccuracy in formation logs can also result from performing logs through a standing column of radioactive fluid in the wellbore if the concentration of radioactivity in the mud is relatively high in relation to the intensities of radiation detected by the permeability log. Certain of the weighting materials used in drilling muds, such as barite, occur naturally together with radioactive compounds, depending upon the particular formation and depth at which weighting materials are mined, as well as a number of other variables. These radioactive compounds can be adsorbed on the mud-weighting minerals or in some instances incorporated into the crystal lattice of the minerals. More rarely, radioactive minerals, such as lanthanide-containing bastnasites, are found mechanically mixed in geological formations containing substantial proportions of a mud-weighting mineral, such as barite.

Radioactive emitting nuclides from drilling muds which penetrate the formation or build up in mud cake along the wellbore have been found to distort well logging measurements used to determine a natural radioactive profile by setting up extraneous background concentrations. Barites, which are the most commonly used of all mud weighting minerals, are particularly susceptible to impurities which emit gamma radiation such as actinium ($Ac^{228}$), lead ($Pb^{212}$), thallium ($Tl^{208}$), and, most particularly, all the daughter products of the thorium decay chain ($Th^{232}$). The natural gamma ray spectral logging technique is particularly affected by radioactive barites in drilling mud because this technique relies on relatively delicate measurements of the ratios of natural gamma radiation from thorium, uranium, and potassium.

To provide a way of correcting well logging measurements to take into account the background effect of radioactive materials in the drilling mud, European Patent Application No. 83301851.8, to Smith, et al. published under Publication No. 0091294A2, discloses a test cell for measuring the radioactivity of materials in drilling mud during drilling. Extraneous background concentrations are determined by this method and measurements made by gamma ray logging are corrected for the presence of radioactivity in the mud.

Certain other techniques take advantage of the filter cake left on the wellbore when filtrate from drilling mud penetrates the wellbore under the hydrostatic pressure exerted by a column of weighted mud. U.S. Pat. No. 3,424,903 to Lawson utilizes this phenomenon to determine the permeability of subterranean formations. The drilling fluid is provided with radioactive material capable of emitting both high and low energy gamma rays in the ranges from zero to 0.8 MeV and from 1.0 to 5 MeV respectively, such as radioactive isotopes of cadmium, iron and antimony. A log is made of the high and low energy radiation emitted from filtrate from the drilling fluid bearing the radioactive material, which penetrates into the formation during drilling, and a ratio of the low to high intensities is computed. The higher attenuation of high energy gamma rays with increasing penetration into the formation is used to indicate the permeability of the formation.

This method possesses the advantage of determining permeability during drilling operations directly from the penetration of drilling mud into the formation, rather than from a subsequently injected fluid so that the permeability profile reflects more nearly an undamaged rather than a damaged or altered state. However this method also possesses several drawbacks. For one, the radioactive additive must be chosen so that it remains evenly distributed throughout the drilling fluid and does not adhere to every substance with which it comes into contact. For another, care must be taken that the radioactive fluid is not displaced so deeply into the formation that it cannot be detected with certainty. Yet another drawback of this method stems from the difficulty of logging the filtrate within the formation through a column of radioactive mud standing in the borehole and the filter cake along the face of the reservoir. Radiation from mud in the borehole can affect accuracy of the logging and mask the contours of the injection profile.

To avoid the disadvantages associated with logging through a column of mud, U.S. Pat. No. 2,810,076 to Mardock discloses a method of determining permeability by plating out radioactive particles suspended within an aqueous carrier fluid upon the face of the wellbore as the carrier fluid penetrates the formation. The walls of the drill hole are first washed or scraped to remove the mud sheath deposited during drilling operations and a log is made of the natural radioactivity of the formation. Then a neutral carrier fluid bearing radioactive particles of a size suitable for plating out on the face of the formation is injected under conditions of continuous agitation to keep the particles suspended. The carrier fluid is displaced into the formation by injecting a neutral fluid maintained under pressure to prevent backflow from the formation, and a second log of the borehole bearing the cake of deposited particles is made. Comparison of radioactive profiles of the first and second logs will reveal the zones of high permeability. However, if fluid from the reservoir backflows into the borehole, the cake of particles will be damaged or displaced and results of the second logging will be highly inaccurate.

One of the main problems of the prior art logging methods is that none provides a reliable way to determine the permeability of a formation before it is damaged. For example, the process of Hamby described above relates to the logging of formations penetrated by a cased borehole; obviously, the operations involved in installing the casing damage the formation so that the results obtained from logging do not accurately reflect the permeabililty characteristics of the formation. Likewise, the logging fluids used by Hamby, and also by Mardock in the patent discussed above, will alter the formation so that the permeability of the area immediately surrounding the wellbore, the area read by the logging tool, no longer relfects the true permeability characteristics of the formation.

SUMMARY OF THE INVENTION

In view of the foregoing, it can be seen that a goal of the art is to provide a logging method that will, as accurately as possible, measure the permeability of a formation penetrated by a wellbore. The present invention provides a method which measures the permeability characteristics of a formation prior to casing operations and without introduction of logging fluids and the like which alter the area surrounding the wellbore from its substantially "virgin" condition, i.e., its condition as produced from the initial drilling operation with a drilling mud.

A method is provided for determining the permeability profile of a borehole penetrating a subterranean formation wherein the borehole is drilled into the formation using a drilling mud containing evenly distributed particles bearing a gamma ray emitting nuclide so that a substantial proportion of the particles accumulates along the face of the wellbore in a filter cake and a gamma ray spectroscopic log of the borehole bearing the substantially intact filter cake is made from which the permeability profile of the subterranean formation is determined.

The log of the wellbore can be made using any of four different techniques. A "measurement-while-drilling loggingtool" can be used to log the formation as drilling operations proceed; (2) a "wire-line" logging tool can be used to log the formation after drilling is completed but while the radioactive drilling mud is still in the borehole; (3) the radioactive mud in the borehole can be replaced with conventional non-radioactive mud while leaving the filter cake intact and "wire-line" logging can be performed; or (4) a log of the borehole bearing the radioactive filter cake can be made using any of the above techniques and then compared with a log of an offset well in the same formation drilled using conventional non-radioactive drilling mud to determine the permeability profile of the formation.

DETAILED DESCRIPTION OF THE INVENTION

In producing oil from underground formations penetrated by a wellbore, it is often desirable to determine the permeability profile of the uncased wellbore before substantial damage to the formation is incurred either by placing and cementing the liner or by contact with fluids. Such information is particularly useful in determining the points at which a cement liner, when it is later installed, should be perforated to reach the oil-producing zones of the formation or in determining the location of thief zones that should be plugged to prevent loss of circulation fluids.

The well logging technique of this invention utilizes conventional logging equipment, such as a gamma ray scintillation counter including that which can be installed in the drill collar above the drill bit, to log the permeability profile of the subterranean formation as the borehole is drilled. Such a device, known in the art as a "measurement-while-drilling logging tool" or a "gamma-ray logging tool," typically utilizes a natural gamma ray strike counter that stores radiation information in a memory device or transmits information up the hole via mud pulses to a mechanism that translates the received data into a chart displaying a record of radioactivity with depth along the hole. Alternatively, conventional "wire-line" logging techniques may be used to record the log of radioactive profiles. In "wire-line" logging, the logging tool is dropped to the bottom of the completed borehole from an electrical cable and then withdrawn slowly while a log of a radioactive filter cake lining the borehole is recorded from bottom to top. Information is transmitted up the hole via electrical impulses sent through the electrical cable.

Typically, modern drilling techniques utilize a weighted drilling fluid, such as an aqueous drilling mud containing particles of dense materials, typically barite. To prevent blowouts, the weight of the drilling fluid in the wellbore should exert sufficient hydrostatic pressure to exceed the formation pressure. In the practice of this invention, the weighted drilling mud can remain in the wellbore during logging operations to exert hydrostatic pressure sufficient to prevent backflow of fluids into the wellbore while the logging equipment records the permeability profile of the formation. Thus, retaining the drilling mud in the borehole during logging assures that backflow from the formation will not destroy the mud cake lining the borehole. Radioactive materials present in or added to the drilling mud which form a gamma ray emitting filter or mud cake along the borehole are used to determine areas of high permeability without the need for introducing a second fluid containing radioactive particles. But the level of radioactivity in the mud is sufficiently low that substantial interference with the results of logging is avoided.

In general, permeability with depth along the wellbore is determined by logging the radioactivity of the filter cake which builds up along the face of the wellbore as the filtrate of the drilling mud permeates the formation under the head of hydrostatic pressure exerted by the drilling mud. Since drilling mud is the first recovery fluid to contact the formation, the mud cake formed during drilling most accurately reflects permeabilities of the undamaged formation with depth along the borehole. As the borehole is drilled, the fluids from the drilling mud enter the undamaged porous structures and zones of high permeability in the formation due to the positive pressure differential exerted by the drilling mud while the radioactive particles collect at the entrance to the porous structures to form a radioactive layer of mud. A radioactive filter cake of particles results along the face of the wellbore such that the thickness of the mud cake and intensity of gamma ray emissions from the particles are substantially increased at depths corresponding to zones of relatively high permeability in the undamaged subterranean formations.

In the practice of this invention, gamma ray emitting particles are added to drilling mud to obtain a concentration of radioactivity low enough to permit the logging equipment to accurately measure permeability of the formation without substantial interference from radioactivity in drilling mud filling the borehole. However, for best results the type and concentration of the gamma emitting nuclides in the drilling mud should also be selected to produce sufficient radioactivity to give a clear radioactive profile of reservoir permeability despite the natural radioactive characteristics of the reservoir.

The gamma-emitting particles are usually small enough to remain suspended in a thixotropic drilling mud while drilling goes forward, yet large enough so that at least some, and preferably a substantial proportion, of the particles will plate out on the face of the wellbore as drilling fluid is forced into the formation. Therefore, particles should be selected to be somewhat larger than the average pore entrance size encountered along the face of the wellbore. Generally, particles of a size between 20 and 120 microns are suitable, but the size of the particle will vary depending upon the average pore size of the individual reservoir as determined by core samples, and the like and by the make up of the drilling mud. Preferably the size of the particles is between about 44 and 74 microns.

A variety of substances are commonly added to drilling muds to add density, most typically barite. In the preferred embodiment of this invention, the radioactive particles added to the drilling mud are mud weighting particles for increased mud density, such as barite, containing gamma-ray emitting nuclides of sufficiently low concentration to avoid radiation hazards to humans and to comport with existing governmental health and safety regulations. Alternatively, other gamma-ray emitting solids, either singly or in combination, and of suitable size, density, and radioactive intensity can be added to the drilling mud, for example, thorium-bearing bastnasite, cerium oxide, or cerium fluoride.

As it has been found that the amount of radioactivity that builds up in the mud cake at any point of high permeability is substantially determined by reservoir permeabililty and not solely by the radioactive intensity of the drilling mud, the concentration of radioactive material in the drilling mud can be maintained at a sufficiently low level to prevent radioactivity in the mud from obscuring the results obtained by the logging tool or from posing a hazard to humans.

Generally, radioactive particles added to the drilling mud are selected to result in mud having radioactivity of between about 30 and 250, for example, between about 100 and 150 gamma ray API units of mud. As needed to adjust the density of the drilling mud to counteract the pressure of the formation, in keeping with normal practices of the art, additional nonradioactive weighting material can be used. Usually, care should be taken in any event to maintain the radioactivity of the drilling mud below about 250 gamma ray API units of mud if radioactivity of the cake is to be measured through a column of drilling mud standing in the hole. Otherwise it is possible that gamma emissions from the mud will mask the radioactive profile of the reservoir.

Weighting materials or other solid mud particles having a suitable concentration of radioactivity to be used in drilling muds during the practice of this invention can be either naturally occurring or achieved using techniques well known in the art for adsorbing radioactive compounds onto weighting materials, such as barite, or other solid mud components, such as particles of ion exchange resin. Additional weighting particles or other solid mud additives particularly suited for this purpose may include bastnasite, cerium oxide, cerium fluoride, or combinations of these. However, additions to the drilling mud of cerium oxide, cerium fluoride, or mixtures thereof, to establish a mud of suitable radioactivity generally result in a mud of unsuitably low pH. When it is desirable to avoid this difficulty, about 50 weight percent or less of the radioactive minerals added to the drilling mud should comprise cerium oxide and cerium fluoride.

In the preferred embodiment, radioactive substances that produce gamma rays in the two of the common channels of spectra for sedimentary formations, i.e., those centered about the 1.76 MeV for uranium, or about 2.62 MeV for thorium, or mixtures thereof, are naturally adsorbed upon, substituted into the crystal lattice of, or mechanically mixed with minerals used as mud weighting particles, most preferably barite. Generally, gamma ray emitting substances centered about the 1.46 MeV channel for potassium 40 should be avoided in clay-bearing reservoirs as potassium 40 is commonly present in clays found in reservoir formations in sufficient abundance to obscure the readings of the permeability log. On the other hand, thorium oxide, and its daughter products, are especially suitable as radioactive additives for determining the permeability profile of a thorium poor reservoir since the permeability profile of the log will remain relatively unobscured by the reservoir's natural radioactive profile.

Most preferably, the radioactive particles added to the drilling mud are weighting particles containing a naturally radioactive mineral bearing uranium or thorium or their daughter products, or mixtures thereof, especially lanthanide-rich compounds which contain thorium, such as cerianite or bastnasite. For example, thorium-bearing bastnasite occurs mechanically mixed with barite as major constituents of the ore from the Mountain Pass Mine in San Bernardino County, California.

It is alternatively contemplated that suitable gamma ray emitting substances alien to those naturally occurring in reservoir rocks may be used, especially those which emit gamma rays at energy levels other than those characteristic of uranium, thorium, and potassium 40. For instance, iodine 131 can be adsorbed onto particles added to the drilling mud. Use of a substance alien to the formation under investigation provides the advantage that radioactive emissions from the filter cake are easily distinguished from those emanating from the formation itself so that zones of higher permeability can be readily determined. However, use of substances alien to sedimentary formations may require adjusting the spectral "windows" in the logging tools to pick up gamma rays in the energy range of the alien radioactive substance.

Whether naturally occurring or alien radioactive materials are used in the practice of this invention, the radioactive particles should generally be insoluble in the thixotropic drilling mud. Insolubility of the particles is important to assure that the particles plate out rather than penetrate the formation in the filtrate. Generally the drilling mud is thixotropic so that the particles will not settle out if agitation of the drilling mud ceases or if the drill-string is pulled. When these requirements are observed in the practice of the invention, a log of the filter cake accurately locates the zones of high permeabililty despite the presence of radioactive mud in the borehole during logging, as in the preferred embodiment. Since the logging tool is normally within a few inches of the radioactive source being measured, that is, the filter cake, the logging results are relatively undistorted by the uniformly distributed radioactive particles present in mud in the borehole during logging.

Usually, suitable naturally occurring radioactive weighting additives contain either uranium or thorium, and their daughter products, since these additives are both radioactive and of high density. If the clays indigenous to the oil bearing formation to be logged also contain high concentrations of naturally occurring uranium and thorium, or their daughter products, the log of the reservoir permeability may be obscured. To avoid this problem, it may be desirable to run natural gamma spectroscopic logs of offset wells drilled in the same formation with conventional muds for comparison with logs made while using a radioactive mud additive.

Alternatively, a log of the same well after it has been cased and cemented may be compared with the open hole log of the filter cake in place. Since a substantial portion of the filter cake is typically removed when the casing is run and the well-bore is conditioned and cemented, a log of the cased wellbore substantially reflects the natural radioactive formation profile. Comparing a log of the mud cake generated by permeation of radioactive fluid into high permeability zones with a log of the natural radioactive formation profile will readily enable one skilled in the art to determine the permeabililty profile of the wellbore.

Once the zones of high permeability have been determined by these methods, one skilled in the art can select those zones which will be suitable for hydrocarbon recovery. Therefore, after logging to determine permeability is completed, the well casing is typically run and a cement is pumped to fill the annulus between the casing and the formation. Using techniques well known in the art, perforations are made through the casing and cement liner at suitable levels to open up the highly permeable hydrocarbon-bearing zones for production. Alternatively, information from the permeability logs may be used to determine which high permeability zones are thief zones and conventional techniques can be employed to plug any thief zones so as to prevent loss of fluid during cementing and recovery operations, and the like.

In yet another alternative embodiment of this invention, the radioactive drilling mud is circulated out of the borehole and a conventional, substantially non-radioactive drilling mud is circulated into the borehole while the radioactive filter cake remains in place and substantially intact along the surfaces of the wellbore. Hydrostatic pressure from the non-radioactive drilling mud should as nearly as possible equal that of the radioactive mud it replaces to prevent backflow from the formation that would damage the filter cake. Once the radioactive mud has been replaced by non radioactive drilling mud, logging of the filter cake can be performed using the "wire-line" spectrosopic logging technique without interference from radioactivity in the drilling mud. This technique is particularly useful when logging a formation of relatively even permeabilities or when using a drilling mud in the higher range of radioactive intensity.

While particular embodiments of this invention have been described, it will be understood that the invention is not limited thereto since many obvious modifications can be made. It is intended to include within this invention any such modifications as will fall within the scope of the appended claims.

We claim:

1. A method for determining the permeability profile of a borehole penetrating a subterranean formation, said method comprising:

a. drilling a borehole into a subterranean formation using a drilling mud containing substantially evenly distributed particles bearing a gamma ray emitting nuclide so that a substantial portion of the particles accumulates along the face of the wellbore in a filter cake;

b. making a gamma spectroscopic log of the borehole bearing the substantially intact filter cake while the formation is being drilled; and c. determining the permeability profile of the subterranean formation from the log of the borehole bearing the filter cake.

2. The method of claim 1 wherein the particles comprise a gamma emitting nuclide alien to the subterranean formation.

3. The method of claim 1 wherein the particles comprise a mud weighting additive bearing gamma emitting nuclides selected from the group consisting of uranium, thorium and potassium, and their daughter products, and mixtures thereof.

4. The method of claim 3 wherein the gamma ray emitting particles comprise a radioactive substance selected from the group consisting of naturally-occurring minerals containing thorium and uranium, and their daughter products, and mixtures thereof.

5. The method of claim 1 wherein the particles comprise a solid mud additive bearing gamma emitting nuclides selected from the group consisting of uranium, thorium and potassium and their daughter products, and mixtures thereof.

6. The method of claim 1 wherein the size of a substantial portion of the particles is greater than the average pore size of the subterranean formation.

7. The method of claim 6 wherein the size of the particles is between about 20 and 120 microns.

8. The method of claim 7 wherein the size of the particles is between about 44 and 74 microns.

9. The method of claim 1 wherein the radioactivity of the gamma ray emitting nuclides in the drilling mud is between about 30 and about 250 gamma ray API units.

10. A method for determining the permeability profile of an uncased borehole penetrating a subterranean formation, said method comprising:

a. drilling a borehole in a subterranean formation using a thixotropic drilling mud comprising radioactive weighting particles bearing gamma ray emitting nuclides, said particles being of a size such that a substantial portion of the particles accumulates along the face of the wellbore in a filter cake;

b. obtaining a gamma spectroscopic log of the borehole bearing the filter cake containing radioactive particles while the formation is being drilled and without removing the weighted drilling mud from the borehole;

c. obtaining a natural gamma ray spectroscopic log of the borehole of an offset well drilled in the subterranean formation using drilling mud containing substantially no gamma ray emitting nuclides; and d. determining a permeability profile of the subterranean formation by comparing the log of the borehole bearing the filter cake from step (b) with the log of the borehole of the offset well from step (c).

11. The method of claim 10 wherein the gamma ray emitting nuclides are adsorbed on the mud weighting particles.

12. The method of claim 10 wherein the gamma ray emitting nuclides are contained within naturally occurring minerals.

13. The method of claim 12 wherein the naturally occurring minerals contain gamma ray emitting nuclides selected from the group consisting of uranium and thorium, and their daughter products, and mixtures thereof.

14. The method of claim 13 wherein the gamma ray emitting nuclides are found in naturally occurring minerals selected from the group consisting of bastnasite, cerium fluoride and cerium oxide, and mixtures thereof.

15. The method of claim 14 wherein a mixture of the naturally occurring minerals comprises about 50 weight percent or less of minerals selected from the group consisting of cerium oxide and cerium fluoride.

16. The method of claim 10 wherein a substantial proportion of the gamma ray emitting nuclides are alien to the subterranean formation.

17. The method of claim 10 wherein the size of the particles is between about 20 and 120 microns.

18. The method of claim 10 wherein the concentration of gamma ray emitting nuclides in the drilling mud is between about 30 and 250 gamma ray API units.

19. The method of claim 10 wherein the concentration of gamma ray emitting nuclides in the drilling mud is between about 100 and 150 gamma ray API units.

20. The method of claim 13, 14, 15, 16, 17 or 19 wherein the permeability profile of the subterranean formation is used to determine which strata of the subterranean formation are oil bearing.

21. The method of claim 13, 14, 15, 16, 17 or 19 wherein the permeability profile of the subterranean formation is used to determine the location of thief zones within the formation.

* * * * *